US006158730A

United States Patent [19]

Coffey

[11] Patent Number: 6,158,730

[45] Date of Patent: Dec. 12, 2000

[54] LOW-PROFILE MECHANICAL CLAMP

[76] Inventor: Keith Coffey, 2209 Fortress, Waterford, Mich. 48329

[21] Appl. No.: 09/377,468

[22] Filed: Aug. 19, 1999

Related U.S. Application Data

[63] Continuation-in-part of application No. 09/224,125, Jan. 2, 1999.

[51] Int. Cl.[7] ..... B25B 1/08

[52] U.S. Cl. ..... 269/236; 269/47

[58] Field of Search ..... 269/236, 47, 239, 269/237

[56] References Cited

U.S. PATENT DOCUMENTS

| | | | |
|---|---|---|---|
| 851,661 | 4/1907 | Hewlett | 269/236 |
| 2,408,560 | 10/1946 | Keehn | 269/47 |
| 2,436,941 | 3/1948 | Sendoykas | 269/47 |
| 2,835,291 | 5/1958 | Blatt et al. | 269/239 |
| 3,222,054 | 12/1965 | Bisulca et al. . | |
| 3,249,351 | 5/1966 | Smith | 269/236 |
| 5,988,615 | 11/1999 | Churoux | 269/47 |
| 6,003,851 | 12/1999 | Araki et al. | 269/239 |

*Primary Examiner*—David A. Scherbel
*Assistant Examiner*—Daniel Shanley
*Attorney, Agent, or Firm*—Harness, Dickey & Pierce, P.L.C.

[57] ABSTRACT

A mechanical clamp for securing a workpiece according to the invention includes a clamp plate having an end for engaging a workpiece and a fulcrum spaced apart from said end. A pivotal handle is pivotally connected to said clamp plate by a connecting rod. A base plate is disposed intermediate the pivotal handle and includes a slot therethrough for receiving the connecting rod. The cam surface of the pivotal handle selectively engages the base plate to cause the clamping force at the end for engaging said workpiece. The fulcrum concentrates that clamping force at the end of the clamp plate.

18 Claims, 2 Drawing Sheets

LOW-PROFILE MECHANICAL CLAMP

CLAIM OF PRIORITY

This application is a continuation-in-part of U.S. patent application Ser. No. 09/224,125, filed Jan. 2, 1999, which is incorporated herein by reference.

BACKGROUND OF THE INVENTION

This invention relates to mechanical clamps and, more particularly, to a low-profile mechanical clamp including a cam for pivoting a clamping member over a fulcrum.

In the automotive quality gage and fixture trade, clamps are used to hold parts to simulate their installed position in or on an automobile. These parts, typically molded, include stand-off features extending from the backside of the part for connection to a contact point of the automobile. In quality checking, these parts are held by the stand-off features to surfaces that simulate the contact points of the automobile. These simulated contact points, or "net" surfaces, permit attachment of the molded part, usually by clamping, so that the part can be assessed for quality, such as stresses or buckling resulting from the connection of the part to the net surface.

Current mechanical clamps require more open space between the part and the surface supporting the net than is usually available in quality testing setups. Thus, these limited spaces do not provide enough space for the swing of an arm of a clamp. Accordingly, quality checking of molded parts attached to nets is accomplished by applying the clamp to the finished front or exterior surface of the molded part. But clamping to the finished front surface of a part impedes quality inspection of the finished front surface. Worse, it also creates a clamping point on the front surface that will not be present when the molded part is installed in the automobile. That is, the clamp exerts a force at a point that would be distant from the actual contact point in the automobile, as well as distant from the simulated contact point of the net surface. Further, this distance from the actual contact point and the clamping force at that distant point causes distortion to the part and its connecting stand-off feature that skews the quality check. Thus, check results cannot properly indicate repeatability and reproducibility.

SUMMARY OF THE INVENTION

Accordingly, the present invention provides a low profile mechanical clamp that accurately simulates the clamping point of a part to a contact point in an automobile for quality checking.

The low profile mechanical clamp according to the invention includes a base plate, a pivotal handle adjacent a first surface of the base plate, and a clamp plate adjacent a second surface of the base opposite the first surface. A connecting rod extends through a slot in the base plate to connect the clamp plate and the pivotal handle. The handle includes a cam surface at the pivoting end of the handle for causing a clamping force on a clamping end of the clamp plate. The clamp plate also includes a fulcrum spaced from the clamping end for the clamping force at the clamping end for engaging the workpiece. A user moving the pivotal handle from a first position to a second position causes the cam surface to engage the first surface of the base plate which in turn causes the clamping force.

DETAILED DESCRIPTION OF THE PREFERRED EMBODIMENT

Figure 1:
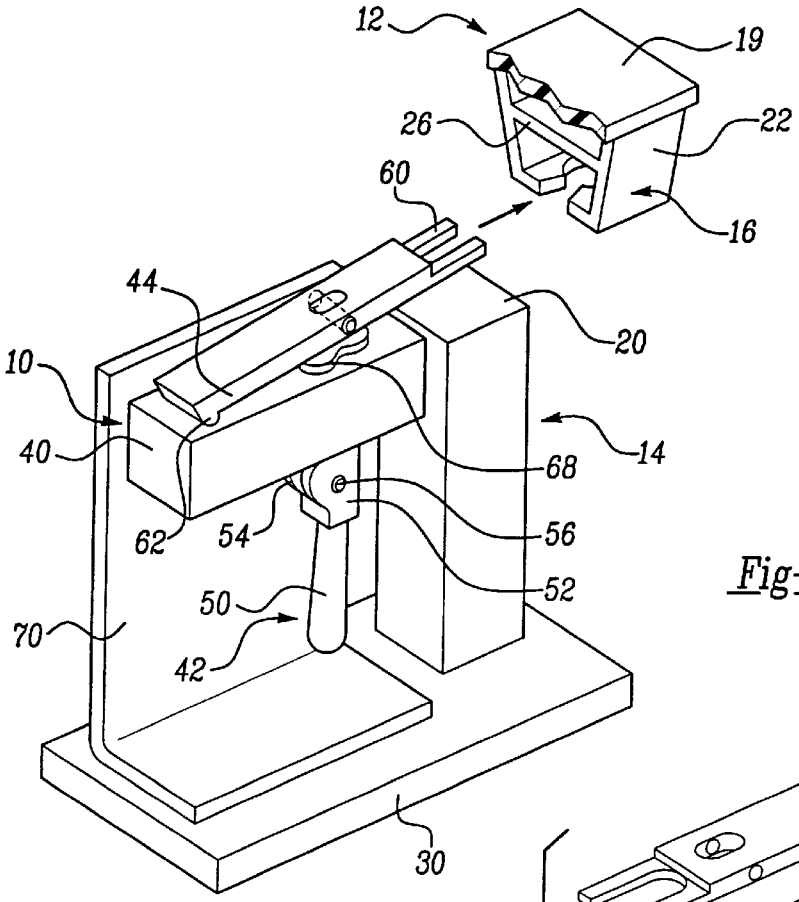
FIG. 1 is a perspective view of a low-profile mechanical clamp according to the invention.

With reference to the drawings, and to FIG. 1 in particular, a low-profile mechanical clamp 10 according to the invention is shown. The mechanical clamp 10 secures a workpiece, preferably a molded part, 12 to a net 14.

The mechanical clamp 10 is particularly well suited for quality testing of molded parts 12, which typically include a stand-off structure 16, also called a global change "doghouse", extending from an inner or supporting surface 18 of the molded part 12. The stand-off structure 16 facilitates the connection of the molded part 12 to a contact point (not shown) of an automobile. The connection is typically achieved by some type of fastener, such as a "Christmas Tree" fastener.

In quality checking, however, that automobile contact point is simulated by the net 14. The net 14 is preferably a post-like structure having a net surface 20 forming a top planar portion thereof. The net surface 20 replicates the contact point of the automobile and the stand-off structure 16 contacts the net surface 20 in quality checking. The net surface 20 may have a locating tab (not shown) for positioning the part 12 on the net 14. Mechanical clamp 10 holds the stand-off feature 16 to the net 14 to accurately simulate the connection of the molded part 12 to the contact point of the automobile.

Figure 3:
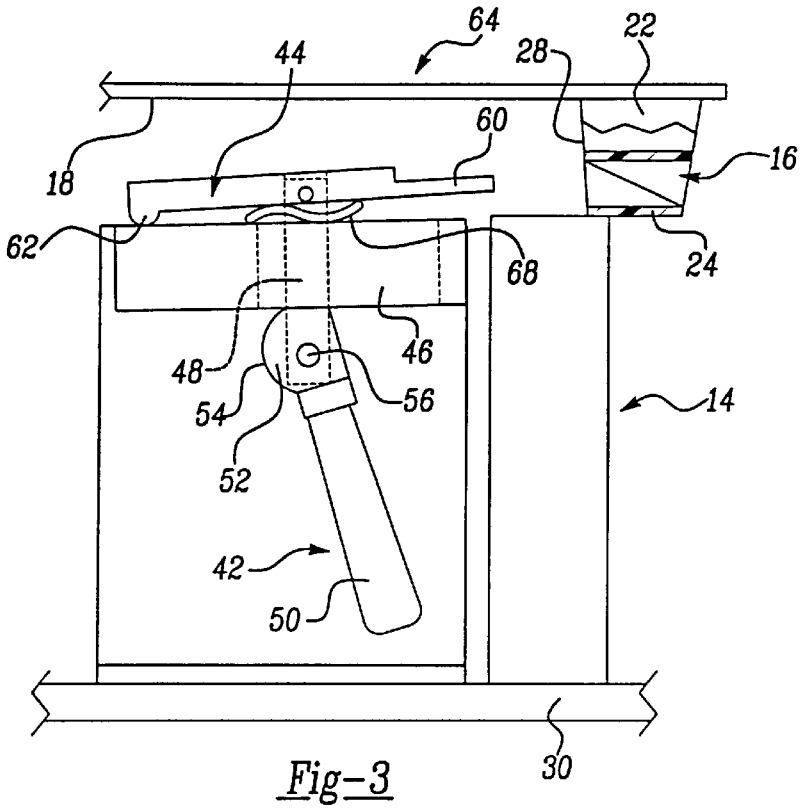
FIG. 3 is a partially sectioned side view of a low-profile mechanical clamp of FIG. 1 prior to engaging the molded part and the net.
Figure 4:
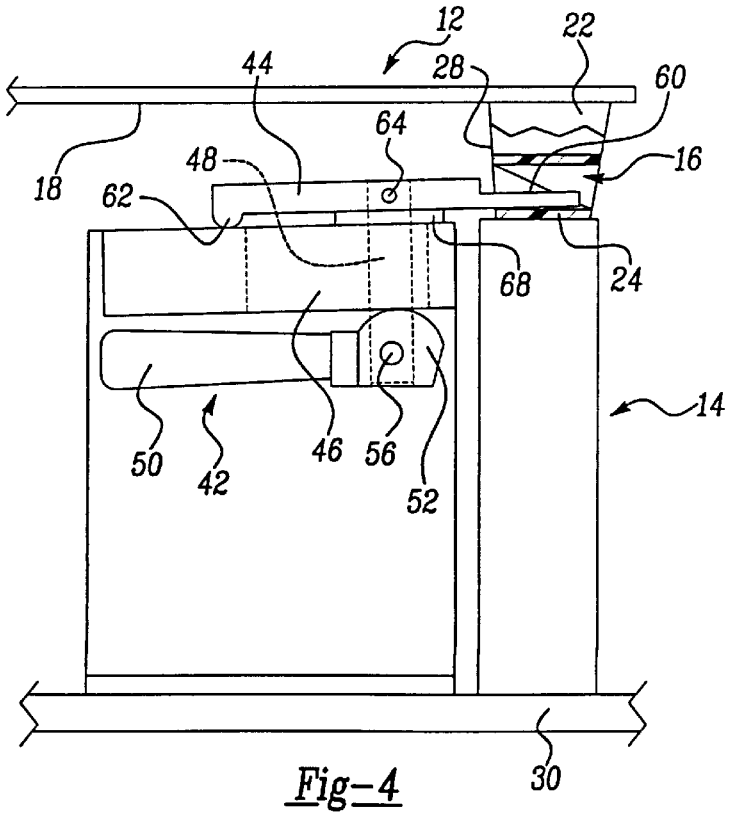
FIG. 4 is a partially sectioned side view of the low-profile mechanical clamp of FIG. 1 clamping the molded part to the net.

The stand-off structure 16 generally includes side walls 22 extending generally perpendicular to supporting surface 18 of molded part 12 and joined at their distal ends by engaging wall 24, as best shown in FIGS. 3 and 4. Depending upon the size and strength of stand-off structure 16, ribs 26 may be included to strengthen the stand-off feature 16. The stand-off structure 16 includes an opening 28 on one side thereof for reception of the mechanical clamp 10.

Net 14 extends generally perpendicularly from a supporting base 30 and has at its opposite end the net surface 20. While the net 14 is shown to generally be rectangular in cross-section, it can vary in shape, as well as length and width. Further, while the net surface 20 is shown to be generally planar, it can vary in shape and structure to simulate any contact point of an automobile.

Figure 2A:
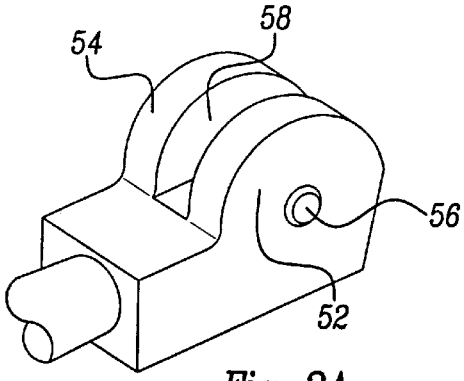
FIG. 2*a* is a partial perspective view of a cam surface of the low-profile mechanical clamp of FIG. 1.
Figure 2:
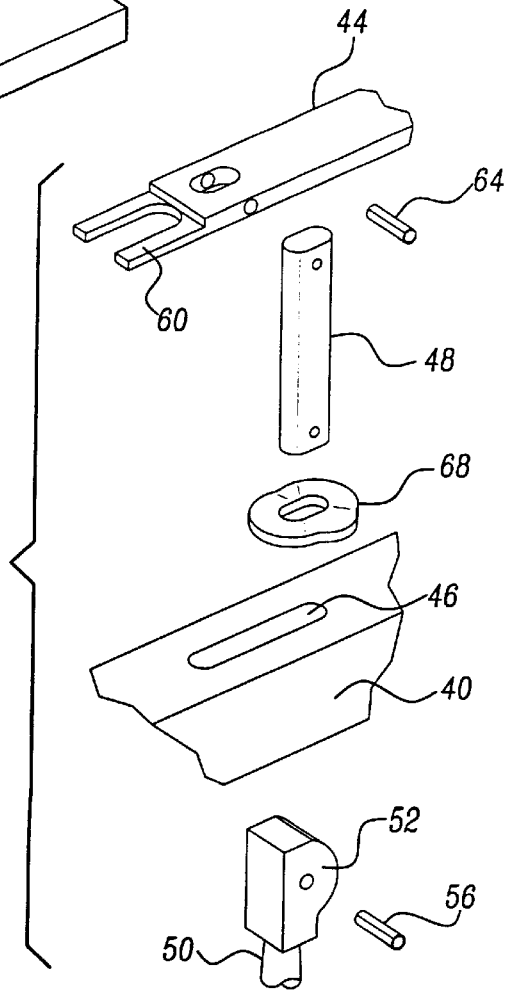
FIG. 2 is an exploded partial view of the low-profile mechanical clamp of FIG. 1.

As best shown in FIGS. 1 and 2, mechanical clamp 10 includes a base plate 40 between a cam handle 42 and a clamp plate 44. The base plate 40 includes an elongated slot 46 disposed medially longitudinally therethrough to facilitate connection of the cam handle 42 to the clamp plate 44 through a connecting rod 48. The base plate 40 is supported by a bracket 70 that is secured to supporting base 30. Preferably, bracket 70 is an L-shaped bracket welded or otherwise fastened to the base plate and extending upwardly generally perpendicular therefrom. At an opposite end, bracket 70 releasably fastens the base plate 40 thereto, preferably through screws (not shown), but can also be secured to bracket 70 in other ways.

The cam handle 42 is an elongated structure including a handle portion 50 at a first end and the cam structure 52 at a second end. Further, the cam structure 52 includes a cam surface 54 having an elongated slot 58 disposed intermediately therethrough for reception of the connecting rod 48. More specifically, the connecting rod 48 is pivotally connected to the cam structure 52 of the cam handle 42 through pivot pin 56, which is journaled in the cam structure 54 on opposite sides of the slot 58.

The clamp plate 44 is generally an elongated rectangular structure having a clamping tip 60 at one end and a bulbous projection 62 at an opposite end. Clamping tip 60 can be shaped rectangular, semi-circular, cylindrical, etc., depending on the requirements of the particular stand-off feature of the molded part. Preferably, the clamping tip 60 is a thinned end portion of the clamping plate 44 to facilitate reception of the tip 60 in the opening 28 of the stand-off feature 16. As shown, the clamping tip 60 is fork-like for engaging a locating tab (not shown) extending upwardly from net surface 20. Bulbous projection 62 extends perpendicular to the longitudinal plane of clamping plate 44 and is disposed adjacent base plate 40. Bulbous projection 62 forms the fulcrum for pivoting clamping plate 60 under the force of cam handle 42, as will be explained in detail below.

The clamp plate 44 also includes an intermediately disposed slot 66 for tight-fit reception of an end of the connecting rod 48. More specifically, the connecting rod 48 is preferably rigidly connected to the clamp plate 44 through a pin 64 extending through slot 66 and the clamp plate 44 on opposite sides of the slot 66. Alternatively, connecting rod 48 can be welded to clamp plate 44. Connecting rod 48 also connects at an opposite end to the cam handle 42. Further, connecting rod 48 is free to move longitudinally in slot 46 of base plate 40, whereby the assembly of clamp plate 44 and cam handle 42 move therewith. Preferably, a spring mechanism biases the clamp plate 44 relative base plate 40. As shown, a spring washer 68 is positioned about the connecting rod 48 between the base plate 40 and the clamp plate 44. The spring washer 68 is preferably a wave-type spring washer that provides a moderate thrust load in a limited radial space. The washer 68 biases the clamp tip 60 of the clamp plate 44 away from the base plate 40 to facilitate insertion of the clamp tip 60 into opening 28 of the stand-off structure 16.

The low-profile mechanical clamp 10 has a first state wherein clamp tip 60 has no clamping forces acting on it. In this state, wave washer 68 biases clamp tip 60 upwardly. Further, in this position, the cam handle 42 is disposed generally perpendicular to the base plate 40 as shown in FIGS. 1 and 3. By clockwise rotation of the cam handle 42, as shown in FIG. 4, the low-profile mechanical clamp 10 is altered to a second state wherein the bias of wave washer 68 is overcome and clamp tip 60 is forced towards base plate 40. Through rotation of the handle 42, cam surface 54 engages the underside of base plate 40 to increase the distance between pivot pin 56 and base plate 40. This change in distance forces clamp plate 44, through pivot pin 64 connecting to connecting rod 48, towards base plate 40. As clamp plate 44 is drawn near to base plate 40, bulbous portion 62 of clamp plate 44 acts as a fulcrum concentrating the clamping forces at clamp tip 60, which is drawn toward base plate 40.

In use, the low-profile mechanical clamp 10 secures molded part 12 to net 14 to simulate the attachment of the molded part 12 to a contact point in an automobile for quality checking. Clamp tip 60 is inserted into the opening 28 in stand-off structure 16 by sliding clamp tip 60 into the opening 28 through longitudinal movement of the connecting rod 48 in the slot 46 of the base plate 40. Once clamp tip 60 is inserted in the opening 28 with the engaging surface 24 between the clamp tip 60 and the net surface 20, the cam handle 42 can be rotated to clamp the part 12 in place. This position is shown in FIG. 4, wherein the cam handle 42 is rotated clockwise until it is disposed generally parallel to base plate 40. In this position the distance between pivot pin 56 and base plate 40 increases, while the distance between pivot pin 64 and the base plate 40 decreases. Also, bulbous portion 62 engages the base plate 40 and functions as a fulcrum to direct a clamping force downwardly at clamp tip 60, which pinches engaging surface 24 against net surface 20. Once clamped, the low-profile mechanical clamp 10 securely connects the part 12 to the net 14 to simulate the connection of the part 12 in an automobile for quality checking without distorting outer or decorative surface 19.

The low-profile mechanical clamp 10 is released by counterclockwise rotation so that part 12 can be removed from net 14 by rotating the handle counterclockwise to the position shown in FIG. 3. This movement decreases the distance of pivot pin 56 from base plate 40 and increases the distance of pivot pin 64 from base plate 40, whereby bulbous projection 62 is free to move relative base plate 40 and no downward pressure is exerted at clamp tip 60. Thus, the low-profile mechanical clamp 10 is removed from the opening 28 of the stand-off structure 16 of the part 12 by sliding clamp plate 44, connecting rod 48, and handle 42 rearwardly.

Once removed from the opening 28 of the stand-off structure 16, the low-profile mechanical clamp 10 is locked for storage by rotating the handle clockwise from the position shown in FIG. 1. The wave washer 68 provides a biasing force that, once overcome by cam structure 52, locks the clamp plate 44 against the base plate 40.

The foregoing discussion discloses and describes an exemplary embodiment of the present invention. One skilled in the art will readily recognize from such discussion and from the accompanying drawings and claims, that various changes, modifications and variations can be made therein without departing from the true spirit and fair scope of the invention as defined by the following claims.

What is claimed is:

1. A mechanical clamp for securing a workpiece, comprising:

a base plate;

a pivotal handle adjacent a first surface of said base plate, said handle including a cam surface and movable from a first position to a second position;

a clamp plate adjacent a second surface of said base plate opposite said first surface, said clamp plate movable relative said base plate and including an end for engaging said workpiece;

a connecting rod pivotally mounted at one end to said pivotal handle and mounted at an opposite end to said clamp plate, said connecting rod extending through an elongated slot in said base plate;

a fulcrum disposed between said second surface of said base plates and said clamp plates, said fulcrum concentrating a clamping force at said end for securing said workpiece;

whereby moving said pivotal handle from said first position to said second position causes said cam surface to engage said first surface of said base plate and said end of said clamp plate to secure said workpiece plate.

2. The mechanical clamp according to claim 1 wherein said clamp plate includes said fulcrum spaced apart from said end for engaging said workpiece.

3. The mechanical clamp of claim 2 wherein said fulcrum is formed by a bulbous projection.

4. The mechanical clamp of claim 2 wherein said fulcrum is disposed at an end opposite said end for engaging said workpiece.

5. The mechanical clamp according to claim 1 further comprising a spring washer between said base plate and said clamp plate.

6. The mechanical clamp according to claim 5 wherein said spring washer is a wave spring washer.

7. The mechanical clamp according to claim 1 wherein said cam surface is disposed at a pivoting end of said pivotal handle.

8. The mechanical clamp according to claim 7 wherein said pivoting end of said pivotal handle is pivotally mounted to said one end of said connecting rod.

9. The mechanical clamp of claim 1 wherein said opposite end of said connecting rod is rigidly connected to said clamp plate.

10. The mechanical clamp according to claim 1 wherein said end for engaging said workpiece is generally fork-like.

11. A mechanical clamp for securing a workpiece, comprising:

a clamp plate including an end for engaging said workpiece and a fulcrum spaced apart from said end for concentrating a clamping force at said end;

a pivotal handle moveable from a first position to a second position and including a cam surface at one end;

a connecting rod pivotally connected at one end to said one end of said pivotal handle and connected at an opposite end to said clamp plate;

a base plate intermediate said pivotal handle and said clamp plate and including an elongated slot therethrough for receiving said connecting rod, said cam surface of said pivotal handle selectively engaging a first surface of said base plate to cause said clamping force at said end for engaging said workpiece.

12. The mechanical clamp of claim 11 wherein said fulcrum is formed by a bulbous projection.

13. The mechanical clamp of claim 11 wherein said fulcrum is disposed at an end opposite said end for engaging said workpiece.

14. The mechanical clamp according to claim 11 further comprising a spring washer between said base plate and said clamp plate.

15. The mechanical clamp according to claim 11 wherein said one end of said pivotal handle is a pivoting end of said pivotal handle.

16. The mechanical clamp according to claim 15 wherein said pivoting end of said pivotal handle is pivotally mounted to said one end of said connecting rod.

17. The mechanical clamp according to claim 11 wherein said end for engaging said workpiece is generally fork-like.

18. A mechanical clamp for securing a workpiece, comprising:

a clamp plate including a first end for engaging said workpiece and a second end opposite said first end including a fulcrum for concentrating a clamping force at said first end;

a pivotal handle including cam surface at a pivoting end;

a connecting rod pivotally connected at one end to said pivoting end of said pivotal handle and rigidly connected at an opposite end to said clamp plate;

a base plate intermediate said pivotal handle and said clamp plate and including an elongated slot therethrough for receiving said connecting rod, said cam surface of said pivotal handle selectively engaging said base to cause said clamping force at said end for engaging said workpiece.

* * * * *